US011517931B2

(12) United States Patent
Gao et al.

(10) Patent No.: US 11,517,931 B2
(45) Date of Patent: Dec. 6, 2022

(54) STEP CAVITY LOW-FREQUENCY ULTRASONIC ATOMIZING NOZZLE HAVING VORTEX FLOW IMPELLER

(71) Applicant: JIANGSU UNIVERSITY, Jiangsu (CN)

(72) Inventors: Jianmin Gao, Jiangsu (CN); Yuhao Shen, Jiangsu (CN)

(73) Assignee: JIANGSU UNIVERSITY

( * ) Notice: Subject to any disclaimer, the term of this patent is extended or adjusted under 35 U.S.C. 154(b) by 315 days.

(21) Appl. No.: 16/608,119

(22) PCT Filed: May 23, 2017

(86) PCT No.: PCT/CN2017/085442
§ 371 (c)(1),
(2) Date: Oct. 24, 2019

(87) PCT Pub. No.: WO2018/201531
PCT Pub. Date: Nov. 8, 2018

(65) Prior Publication Data

US 2020/0130007 A1 Apr. 30, 2020

(30) Foreign Application Priority Data

May 4, 2017 (CN) ..... 201710308614.X

(51) Int. Cl.
*B05B 17/06* (2006.01)
*B05B 1/34* (2006.01)

(52) U.S. Cl.
CPC ..... *B05B 17/0615* (2013.01); *B05B 1/341* (2013.01)

(58) Field of Classification Search
CPC ... B05B 1/341; B05B 17/0615; B05B 7/2424; B05B 7/0433; B05B 1/02; B05B 1/3415;
(Continued)

(56) References Cited

U.S. PATENT DOCUMENTS 3,226,029 A * 12/1965 Goodman ..... B05B 17/0692 239/589.1
3,701,482 A * 10/1972 Sachnik ..... B05B 7/0056 261/DIG. 26
(Continued)

FOREIGN PATENT DOCUMENTS

CN 102294313 12/2011 ..... B05B 1/12
CN 102500502 6/2012 ..... B05B 17/06
(Continued)

OTHER PUBLICATIONS

Office Action issued in U.S. Appl. No. 16/604,882, dated May 25, 2021, 13 pages.
International Search Report (w/translation) and Written Opinion (w/machine translation) issued in application No. PCT/CN/2017/085442, dated Feb. 7, 2018 (12 pgs).
(Continued)

*Primary Examiner* — Christopher R Dandridge
(74) *Attorney, Agent, or Firm* — Hayes Soloway P.C.

(57) ABSTRACT

A step cavity type low frequency ultrasonic atomization nozzle with a swirlable vortex impeller, has an air intake casing, an inlet casing, a Laval core, a fixed cap, an adjustable pedestal, and taper rectifying sleeve, swirlable vortex impeller, stepped resonance tube, regulative plunger, positioning lead, second pedestal. The regulative plunger is located in the second stepped hole of the stepped resonance tube, and its axial position is adjustable; the swirlable vortex impeller is fixed on the taper resonance tube through the bearing, and the outer cone surface is matched with the inner cone surface of the taper rectifying sleeve. The resonant cavity is improved so that the two-phase fluid in the cavity can generate higher frequency and greater fluctuation of the pressure fluctuation amplitude, optimize the initial atomization performance of the nozzle, and optimize the nozzle outlet, and increase the swirlable vortex impeller.

12 Claims, 3 Drawing Sheets

(58) Field of Classification Search
CPC ..... B05B 17/0623; B05B 17/063; B05B 17/0692; B05B 17/0607; B05B 17/0433; B01F 31/85; B01F 23/40
See application file for complete search history.

(56) References Cited

U.S. PATENT DOCUMENTS

| | | | | |
|---|---|---|---|---|
| 3,806,029 | A | 4/1974 | Hughes | 239/3 |
| 4,408,719 | A | 10/1983 | Last | 239/417 |
| 5,501,401 | A | 3/1996 | Munk | 239/431 |
| 6,126,086 | A | 10/2000 | Browner et al. | 239/102.1 |
| 2008/0054091 | A1 | 3/2008 | Babaev | 239/102.2 |
| 2008/0314314 | A1 | 12/2008 | Erickson et al. | 118/302 |
| 2009/0026291 | A1 | 1/2009 | Shimada | 239/405 |
| 2010/0193600 | A1* | 8/2010 | Di Loreto | C23C 24/04 239/8 |
| 2019/0054492 | A1 | 2/2019 | Gao et al. | B05B 17/0607 |

FOREIGN PATENT DOCUMENTS

| | | | |
|---|---|---|---|
| CN | 203508288 | 4/2014 | B05B 17/06 |
| CN | 105834054 | 8/2016 | B05B 17/06 |
| CN | 106423607 | 2/2017 | B05B 7/04 |

OTHER PUBLICATIONS

International Search Report and Written Opinion (w/translations) issued in application No. PCT/CN/2017/084644 dated Nov. 22, 2017 (14 pgs).
U.S. Appl. No. 16/604,882, filed Oct. 11, 2019.
Notice of Allowance issued in U.S. Appl. No. 16/604,882, dated Aug. 18, 2021, 7 pages.
International Preliminary Report on Patentability (w/translation) issued in application No. PCT/CN/2017/085442, dated Nov. 5, 2019 (8 pgs).
International Preliminary Report on Patentability (w/translation) issued in application No. PCT/CN/2017/084644 dated Oct. 22, 2019 (7 pgs).

* cited by examiner

STEP CAVITY LOW-FREQUENCY ULTRASONIC ATOMIZING NOZZLE HAVING VORTEX FLOW IMPELLER

TECHNICAL FIELD

The invention relates to a two-phase atomization nozzle, in particular to a step cavity type low-frequency ultrasonic atomization nozzle with a swirlable vortex impeller.

BACKGROUND TECHNIQUE

At present, in the field of aeroponics, the atomization methods used mainly include piezoelectric ultrasonic atomization and mechanical atomization (such as two-phase atomization of better droplets). Piezoelectric ultrasonic atomization nozzles have the advantages of small and uniform droplets, but its small amount of atomization, only used for small-scale atomization cultivation; the advantages of two-phase atomization nozzle is the large amount of atomization, the disadvantage is that droplet size is large and poor uniformity. Therefore, optimizing the design of the two-phase flow nozzle to fully utilize the energy of the high-speed air flow, it is imperative to develop an atomization nozzle that can generate fine and uniform high-quality droplets and a large amount of atomization.

SUMMARY OF THE INVENTION

In view of the deficiencies of the lack of existing technology, the invention discloses a step cavity type low frequency ultrasonic atomization nozzle with a vortexable impeller. By optimizing the shape of the two-phase flow nozzle cavity and optimizing the flow path of the two-phase flow nozzles, a large number of uniform ultra-fine mist droplets can be generated under low energy consumption conditions. The invention adopted the specific technical solutions as follows:

A step cavity type low frequency ultrasonic atomization nozzle with a swirlable vortex impeller includes an intake casting, an inlet casing, a Laval core, a fixed cap, a first adjustable pedestal, a taper rectifying sleeve, and a swirlable vortex impeller, stepped resonance tube, regulative plunger, positioning lead, second pedestal; the inlet casing has an inlet hole in the center and a inlet hole in the side wall; the first through-hole in the center of the tape rectifying sleeve has a cylindrical section and a conical section; a threaded hole is formed at a center of the second pedestal, and a rectangular groove is formed on an end surface of the second pedestal; and the first adjustable pedestal is threadedly connected to the outer ring of the intake casing and axial position of the first adjustable pedestal is adjustable; the taper rectifying sleeve, the second pedestal are fixed on the first adjustable pedestal through the positioning lead; the inlet casing, the core of the Laval core and the fixed cap are located in the space surrounded by the second through-hole of the cylindrical section of the inlet casing and the taper rectifying sleeve; one end of the fixed cap is threadedly connected to the intake casing, and the inlet casing has a second through-hole in the center and is installed in the air inlet casing, and a sealing ring is arranged between the inlet casing and the air intake casing. The water jacket extends into the fixed cap. Both ends of the Laval core are fixedly connected to the end of the inlet casing and the end surface of the cylindrical segment hole of the fixed cap through the metal glue; the inlet and the inlet casing, the third through-hole of the Laval core constitutes a gas passage; said the inlet, the gap between the Laval core and the inlet casing, the fourth through-hole of the fixed cap, constitutes a liquid passage; the resonant cavity of the stepped resonance tube is in a stepped shape, one end is fixedly connected with the second pedestal through a regulative plunger, and the other end extends to the end face of the fixed cap; the swirlable vortex impeller passes through the bearing is mounted on a stepped resonance tube and is located in a conical section of a first through-hole of a taper rectifying sleeve. The longitudinal section of the vortexable impeller is conical, and there is a gap between the external conical surface of the swirlable vortex impeller and the conical rectification sleeve, and a ring-shaped groove is provided on the end surface of the fixed cap. The longitudinal groove of the annular groove has a parabolic shape, and the annular groove and the end face of the swirlable vortex impeller form a second resonance region. The plunger body of the regulative plunger is located in the second stepped hole of the stepped resonance tube and is internally in interference fit with the second stepped hole and functions as a seal. The depth of the second-order hole of the stepped resonance tube is adjusted by adjusting the axial position of the regulative plunger; the plunger body is also connected with a needle exciter which passes through the resonant cavity of the stepped resonance tube and extends to the Laval core.

Preferably, the ratio of the first stepped hole to the second stepped hole of the second-order cavity of the stepped resonance tube is 1.5-3, and the ratio of the depth of the second stepped hole to the first-order hole is adjustable in the range of 1-5.

Preferably, the inner surface of the resonator of the stepped resonance tube is saw-toothed.

Preferably, the inclination angle of the sawtooth longitudinal section of the inner surface of the resonant cavity is 12-25°, and the saw tooth length is 1.5-2.5 mm.

Preferably, the parabolic line profile of the cross-section of the annular groove on the end face of the fixed cap is: $x=my^2+ny+p$, the slope of the end curve of the parabola near the center of the fixed cap is the same as the slope of the conical surface of the taper rectifying sleeve.

Preferably, the clearance between the swirlable vortex impeller and the inner conical surface of the taper rectifying sleeve is 0.5-1 mm, and the clearance between the wall surface of the center hole of the swirlable vortex impeller and the outer surface of the stepped resonance tube is 0.2-0.4 mm.

Preferably, the angle $\alpha$ between the connecting line of the starting point and the ending point of the pressure surface of the swirlable vortex impeller blade is 25°-35°.

Preferably, the blades of the vortexable impeller are unequal thickness blades, the contour curve of the pressure surface of the blade is a cubic polynomial curve $y=ax^3+bx^2+cx+d$, and the pressure surface profile curve is determined by the position and slope of the starting point and the ending point; the profile curve of the suction surface of the blade is an arc $x^2+y^2+ex+fy+g=0$, and the suction surface profile is determined by the position of the starting point and the ending point and the starting point slope.

Preferably, the exciter diameter is 0.5-0.8 mm, the material of the plunger body is aluminum alloy 1050, the outer surface of the aluminum alloy cylinder is covered with polyurethane rubber, and the thickness of the rubber layer is 0.3-0.5 mm.

Preferably, the taper hole angle of the taper rectifying sleeve is 60°, the slope of the end curve of the parabola closer to the center of the fixed cap is $\sqrt{3}/3$, the cone angle of the outer conical surface of the swirlable vortex impeller is 60°. Taper rectifying sleeve has an annular groove on the outer cylinder surface at a distance of 5-10 mm from the end surface, and a sealing gasket is installed between the bottom surface of the taper rectifying sleeve and the adjustable pedestal.

The liquid is merged with the high-speed air flow at the out of the Laval core. The liquid is impacted and broken up to form large droplets. The first atomization occurs. The droplet group continues to enter the stepped resonant cavity with the high-speed jet, and the first regular resonance of a two-phase fluid in a stepped resonator, the fluid in the cavity oscillates at frequency about 5-12 KHz, the large droplets are further shredded and refined, and the second atomization occurs; the fixed cap face groove and the taper rectifying sleeve is combined to form a second resonance zone, the mist enters the second resonance zone after exiting from the stepped resonance cavity. In the second resonance zone, the two-phase fluid oscillates irregularly, so that the fog is sprayed for the third time. The droplet size is further reduced; the droplet finally enters the vane space of the swirlable vortex impeller under the action of the fluid pressure, and under the action of the fluid pressure, the swirlable vortex impeller rotates at a high speed, and the droplet rotates with the impeller at a high speed. The centrifugal motion occurs when flying out of the impeller, and the fourth atomization of the droplet occurs under the effect of centrifugal force, at the same time, the droplet distribution is more uniform.

In the present invention, the shape of the resonant cavity is set to be a ladder type, and the sudden change in the space within the resonant cavity increases the resonant frequency of the fluid in the tube, reaching 1.7 times before the change, the maximum frequency can reach 12.137 kHz. The increase of resonance frequency plays a positive role in the second atomization process of the nozzle. At the same time, the inner surface of the stepped resonant cavity is set to a sawtooth shape. When the two-phase flow is refluxed out of the resonant cavity, the mist collides with serrated protrusions multiple times, the local two-phase flow will produce a local disturbance, the sawtooth shape intensifies the instability of the two-phase fluid in the cavity, and enhances the fluctuation of the fluid in the cavity, which is favorable for the fluid in the cavity to enter the resonance state more easily.

The annular groove of the end face of the fixed cap and the end face of the taper rectifying sleeve constitute a second resonance region, and the high-speed two-phase fluid irregularly reflects and oscillates in the second resonance region, so that the sound pressure level during the working of the nozzle is increased by about 10 dB. The strong sound field area is conducive to further cracking and refining of the fog droplets.

A swirlable vortex impeller is installed at the outlet of the nozzle. On the one hand, the high-speed swirlable vortex impeller further refines the centrifugal movement of the droplet. On the other hand, the droplet distribution is more uniform in the space within the injection angle range.

Finally, the exciter penetrates deep into the outlet section of the Laval nozzle. The exciter can effectively reduce the total pressure at the opening of the stepped resonance tube, which is beneficial to the discharge of compressed gas in the resonant cavity and also makes it easier for the two-phase fluid to reach resonance. When the air supply pressure is greater than 0.15 MPa, the resonance frequency of the resonator of the stepped resonance tube is adjustable from 5.45 kHz to 12.137 kHz.

1—Intake Casing; 2—Inlet Casing; 3—Seal; 4—Inlet; 5—Adjustable Pedestal; 6—Positioning Lead; 7—Taper Rectifying Sleeve; 8—Swirlable vortex Impeller; 9—second pedestal; 10—bearing; 11—stepped resonance tube; 12—regulative plunger; 13—compression nut; 14—fixed cap; 15—Laval Core; 16—inlet Hole; 1201—exciter; 1202—plunger body; 1203—fixed shaft

DESCRIPTION OF EXEMPLARY EMBODIMENTS

The present invention will be further described below with reference to the accompanying drawings and specific embodiments, but the scope of protection of the present invention is not limited thereto.

Figure 1:
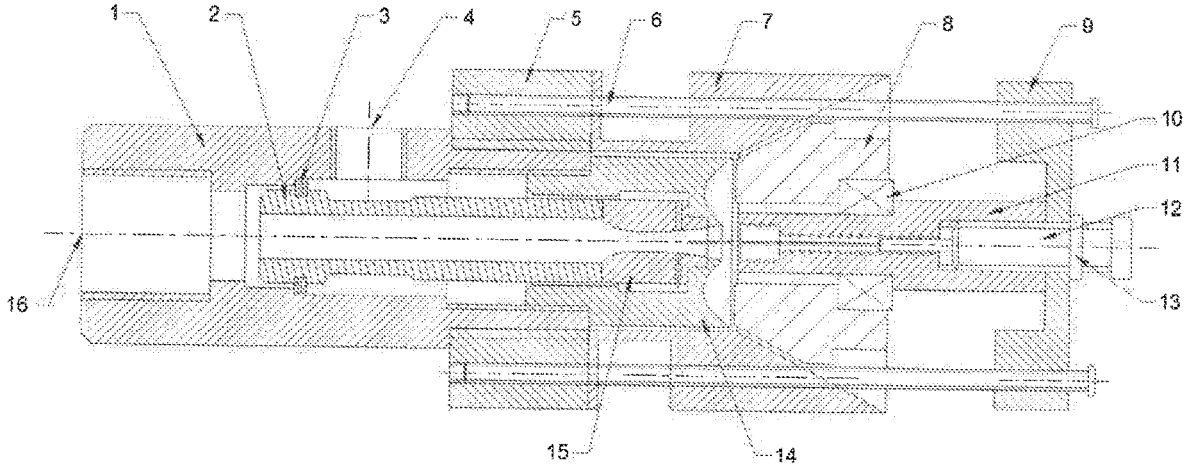
FIG. 1 is a sectional view of a step cavity type low frequency ultrasonic atomizing spray head with a vortexable impeller according to the present invention.

As shown in FIG. 1, the step cavity type low frequency ultrasonic atomization nozzle with a swirlable vortex impeller according to the present invention mainly comprises an air intake casing 1, a water inlet casing 2, a Laval core 15, and a fixed cap 14, the first adjustable pedestal 5, the taper rectifying sleeve 7, the swirl able vortex impeller 8, the stepped resonance tube 11, the regulative plunger 12, the positioning lead 6, and the second pedestal 9 are formed. The intake casing 1 has an inlet hole 16 in the center and an inlet in the sidewall; the first through-hole at the center of the taper rectifying sleeve 7 has a cylindrical section and a conical section; a screw hole is formed in the central position of the second pedestal 9, and a rectangular groove is formed on one end surface of the second pedestal 9. The adjustable pedestal 5 is screwed on the outer ring of the intake casing 1, and the axial position of the adjustable pedestal 5 can be tuning; the taper rectifying sleeve 7 and the second pedestal 9 are fixed on the first adjustable pedestal 5 by the positioning lead 6; the outer surface of the taper rectifying sleeve 7 is opened at a distance of 5-10 mm from the tip surface. The annular groove is provided with a sealing washer between the bottom end surface of the taper rectifying sleeve 7 and the adjustable pedestal 5. The inlet casing 2, the Laval core 15, and the fixed cap 14 are all located in the space enclosed by the through hole of the cylindrical section of the intake casing 1 and the taper rectifying sleeve 7. One end of the fixed cap 14 is threadedly connected to the intake casing 1. The outer diameter of the inlet casing 2 is slightly smaller than the inner diameter of the intake casing 1. The center of the inlet casing 2 has a second through-hole and is installed in the inlet casing 1. In the intake casing 1, a seal 3 is provided between the inlet casing 2 and the intake casing 1. The water inlet casing 2 extends into the fixed cap 14, and both ends of the Laval core 15 are fixedly connected with the ends of the inlet casing 2 and the cylindrical segment hole end surface of the fixed cap 14 through the metal glue. The air hole of the intake casing 1, the inlet casing 2 and the third through-hole of the Laval core 15 constitute a gas passage, and the inlet, the inlet casing 2 and the Laval core 15 and the intake casing 1, the gap between the fourth through-holes of the fixed cap 14 and the liquid inlet hole of the Laval core 15 constitute a liquid passage.

Figure 2:
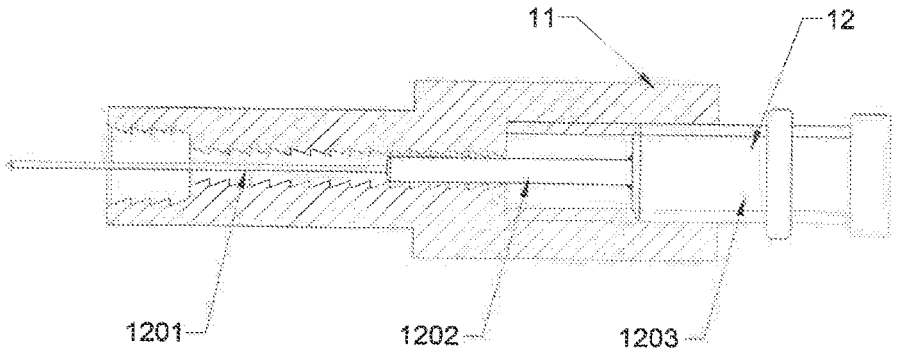
FIG. 2 shows the regulative plunger and stepped resonance tube matching diagram.

As shown in FIG. 2, the resonance cavity of the stepped resonance tube 11 is a second stepped hole, the inner surface of the resonant cavity is saw-tooth type, the inclination angle of the sawtooth longitudinal section is 12-25°, and the saw tooth length is 1.5-2.5 mm. The closed end of the stepped resonance tube 11 has a threaded hole, and the threaded hole cooperates with the fixed shaft 1203 of the regulative plunger 12 to realize the adjustable depth of the second stepped hole of the stepped resonant cavity. The regulative plunger 12 is composed of three sections. The first section is the exciter 1201, the second section is the plunger body 1202, the third section is the fixed shaft 1203, the fixed shaft 1203 is threaded on the cylindrical surface, and the material of the plunger body 1202 is aluminum alloy 1050, the outer surface of the aluminum alloy cylinder is covered with polyurethane rubber, and the thickness of the rubber layer is 0.3-0.5 mm. One end of the stepped resonance tube 11 is fixedly connected to the second pedestal 9 through the regulative plunger 12. The plunger body 1202 of the regulative plunger 12 is located in the second stepped hole, the interior of the stepped resonance tube 11, and the second stepped hole has an interference fit that acts as a seal to ensure that the seal does not leak. The depth of the second stepped hole in the stepped resonance tube 11 is adjusted by adjusting the axial position of the regulative plunger 12. The sawtooth shape of the inner surface of the stepped resonator cavity exacerbates the instability of the two-phase fluid in the cavity, which will enhance the fluctuation of the fluid in the cavity, making it easier for the two-phase fluid to form a resonance. In addition, when the compressed fluid flows out of the resonant cavity, the droplets collide with the serrated surface of the cavity wall several times when flowing out with the gas, which is beneficial to the further refinement of the mist droplets.

The ratio of the first stepped hole to the second stepped hole of the second-order cavity of the stepped resonance tube 11 is 1.5-3, and the ratio of the depth of the second stepped hole to the first stepped hole is adjustable in the range of 1-5.

The other end of the stepped resonance tube 11 extends to the end surface of the fixed cap 14; the swirlable vortex impeller 8 is mounted on the stepped resonance tube 11 through a bearing and is located in a conical section of the first through-hole of the taper rectifying sleeve 7. The outer surface of the stepped resonance tube 11 is a stepped shaft to achieve the installation and positioning of the bearing 10. The longitudinal section of the swirlable vortex impeller 8 is tapered, and there is a gap between the outer cone surface of the swirlable vortex impeller 8 and the inner cone surface of the taper rectifying sleeve 7. The gap between the swirlable vortex impeller 8 and the inner cone surface of the taper rectifying sleeve 7 is 0.5-1 mm, and the gap between the center hole wall surface of the swirlable vortex impeller 8 and the outer surface of the stepped resonance tube 11 is 0.2-0.4 mm. A ring-shaped groove is provided on the end face of the fixed cap 14, and the longitudinal groove shape of the ring groove is parabolic. The ring-shaped groove and the end surface of the swirlable vortex impeller 8 form a second resonance region. The exciter 1201 passes through the resonant cavity of the stepped resonance tube 11 and extends to the outlet section of the Laval core 15. The exciter 1201 effectively reduces the total pressure at the opening of the stepped resonance tube 11 and facilitates the discharge of compressed gas in the cavity. It also makes the two-phase fluid easier to reach resonance. When the air supply pressure is greater than 0.15 MPa, the resonance frequency of the resonator of the stepped resonance tube 11 is adjustable from 5.45 kHz to 12.137 kHz.

Figure 3:
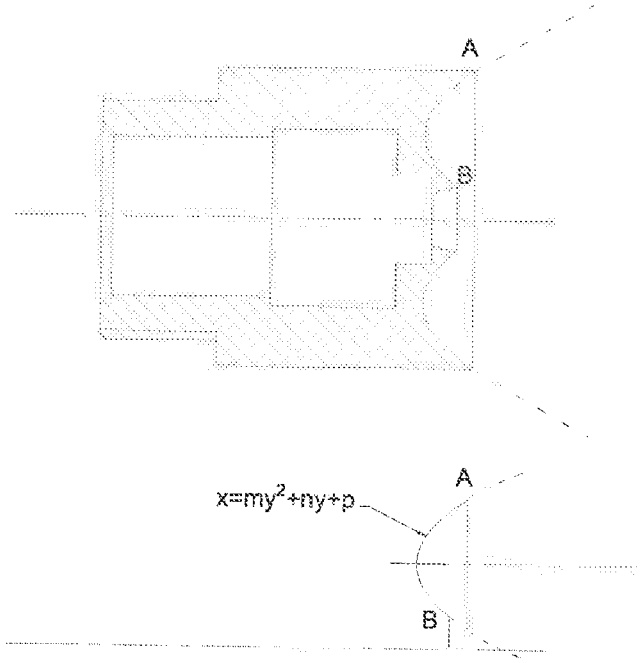
FIG. 3 is a cross-sectional view of the fixed cap end and the end face line type comparison chart.

As shown in FIG. 3, the parabolic line shape of the section of the annular groove on the end surface of the fixed cap 14 is determined by the coordinates of point A, its slope, and the coordinates of point B. The slope of the end curve of the parabola near the center of the fixed cap 14 is the same as that of the conical surface of the taper rectifying sleeve 7, and the annular groove is smoothly connected with the taper rectifying sleeve 7. The tapered cone angle of the taper rectifying sleeve 7 is 60°, the slope of the end curve of the parabola near the center of the fixed cap 14 is a slope of the outer-conical surface of the swirlable vortex impeller 8 is 60°.

As shown in FIGS. 1 and 3, the parabolic groove in the longitudinal section causes the two-phase fluid to be smoothly led to the second resonance region after flowing out of the stepped resonance tube 11. In this region, the high-speed two-phase fluid is in the second resonance region. The irregularly reflected oscillations increase the sound pressure level of the sprinkler during operation by approximately 10 dB to approximately 95 dB.

Figure 4:
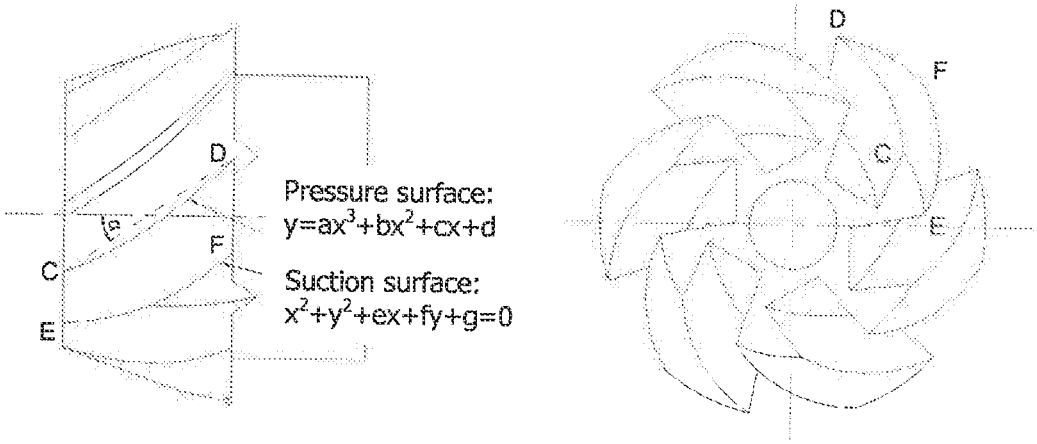
FIG. 4 is a two-dimensional schematic view of a swirlable vortex impeller.
Figure 5:
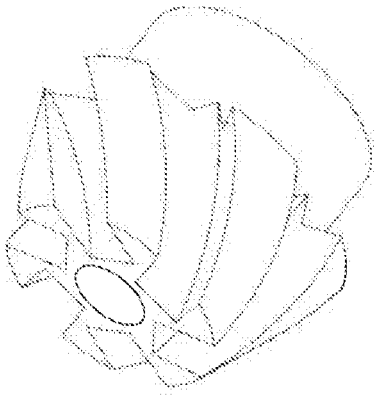
FIG. 5 shows a three-dimensional view of a swirlable vortex impeller.

As shown in FIG. 4 and FIG. 5, the longitudinal section of the swirlable vortex impeller 8 is conical, the cone angle is 60°, and the angle $\alpha$ between the starting point and the ending point of the pressure surface of the blade is 25°-35°. The blades of the swirlable vortex impeller 8 are unequal thickness blades. The contour curve of the pressure surface of the blade is a cubic polynomial curve. The contour curve of the blade suction surface is a circular arc, and the pressure surface profile curve is from the starting point C and the ending point. The position coordinates and slope of D are determined. The suction surface type is determined by the position coordinates of the starting point E and the ending point F and the slope of the starting point. The slope of the starting point is set to 0.3 to 0.7, and the slope of the ending point is set to 0.5 to 1. The supply pressure adjustment range is 0.15-0.5 MPa, and the rotation range of the swirlable vortex impeller 8 is 400-1000 r/min.

At the time of installation, the inlet casing 2, the Laval core 15 and the fixed cap 14 are first fixed together with metal glue, and then the fixed cap 14 is screwed into the inner threaded hole at the end of the inlet casing 1; the swirlable vortex impeller 8 is fixedly connected to the shoulder of the stepped shaft of the stepped resonance tube 11 through the bearing 10, and the second pedestal 9 and the stepped resonance tube 11 are fixedly connected by adjusting the fixed shaft 1203 of the regulative plunger 12; the positioning lead 6 is screwed into the corresponding screw hole of the second pedestal 9, the taper rectifying sleeve 7 and the first adjustable pedestal 5 in order as shown in FIG. 1, and the relative positions thereof are adjusted.

Working Example: High-pressure gas 0.15-0.5 MPa is connected by the air intake hole 16 at the end of the nozzle, and the liquid is merged with the high-speed air flow at the exit of the Laval tube. The liquid is impacted and broken up to form a large droplet, the first atomization occurs, and then the droplets continue to enter the stepped resonant cavity with high-speed jets. The first phase of the two-phase fluid resonates regularly in the stepped resonant cavity. The fluid in the cavity oscillates at a frequency of about 5-12 KHz, and the large droplets are further cracked and refined. A second atomization occurs. In this process, the sawtooth type changes on the inner surface of the exciter 1201 and the stepped resonance tube 11 all contribute to the stable resonance of the step type resonant cavity; the mist enters from the step type resonant cavity and enters the second resonance region and the second resonance region is an internal space region formed by the combined combination of the end face groove of the fixed cap 14 and the taper rectifying sleeve 7. In the second resonance region, the two-phase fluid oscillates irregularly, and the sound pressure level of the strong sound field is about the 95 dB region is favorable for further fogging and refining of the fog droplets, so that the third atomization of the fog droplets occurs, and the particle size of the droplets further decreases; finally, the droplets enter the blade gap of the swirlable vortex impeller 8 under the action of the fluid pressure. In the meantime, under the action of the fluid pressure, the swirlable vortex impeller 8 rotates at a high speed of 400-1000 r/min, the supply pressure adjustment range is 0.15-0.5 Mpa, the droplets rotate with the impeller at high speed, and centrifugal occurs when flying out of the impeller. In the movement, the fourth atomization of the droplet occurs under the effect of centrifugal force, and at the same time, the distribution of the droplets is more uniform. At the same time, the high-speed rotation of the swirlable vortex impeller 8 makes the droplet cluster more evenly distributed in the space area within the injection angle range.

The embodiment is a preferred embodiment of the present invention, but the present invention is not limited to the above embodiment, and any obvious improvement, substitution, or substitution can be made by those skilled in the art without departing from the spirit of the present invention. Variations all fall within the protection scope of the present invention.

The invention claimed is:

1. A step cavity type low-frequency ultrasonic atomization nozzle with a swirlable vortex impeller comprising:

an intake casing, an inlet casing, a Laval core, a fixed cap, a first adjustable pedestal, a taper rectifying sleeve, a swirlable vortex impeller, a stepped resonance tube, a regulative plunger, a positioning lead, and a second pedestal;

wherein the intake casing has an inlet hole in the center and an inlet in a sidewall;

a first through-hole in the center of the taper rectifying sleeve has a cylindrical section and a cone, and a threaded hole is formed in a central position of the second pedestal, a rectangular groove is formed on one end surface of the second pedestal, and the first adjustable pedestal is screwed into an outer ring of the intake casing;

wherein an axial position of the first adjustable pedestal is adjustable;

wherein the taper rectifying sleeve and the second pedestal are fixed by a positioning screw on the first adjustable pedestal, wherein the inlet casing, Laval core and fixed cap are all located on the intake casing, wherein one end of the fixed cap is threadedly connected to the intake casing, wherein the center of the inlet casing has a second through-hole and is installed in the intake casing, wherein a seal is arranged between the inlet casing and the intake casing, and the inlet casing extends into the fixed cap, wherein the two ends of the Laval core are respectively fixedly connected with an end of the inlet casing and an end face of a cylindrical section of the fixed cap through a metal glue;

wherein the inlet of the intake casing, inlet casing and third through-holes of the Laval core constitute gas passages, wherein the inlet, the inlet casing and the Laval core and the intake casing, a gap between a fourth through-hole of the fixed cap and the inlet hole of the Laval core constitute a liquid passage;

wherein a resonant cavity of the stepped resonance tube is in the form of a step, wherein one end of the resonant cavity is fixedly connected with the second pedestal through the regulative plunger, and the other end extends to an end face of the fixed cap;

wherein the swirlable vortex impeller is mounted on the stepped resonance tube through a bearing above, and located in a conical section of the first through-hole of the taper rectifying sleeve, wherein a longitudinal section of the swirlable vortex impeller is conical, there is a gap between an outer conical surface of the swirlable vortex impeller, wherein an inner cone surface of the taper rectifying sleeve, and an annular groove is provided on the end surface of the fixed cap, wherein the longitudinal groove shape of the annular groove is a parabolic shape;

wherein the annular groove and end surface of the swirlable vortex impeller forms a second resonance region;

wherein a plunger body of the regulative plunger is located in a second stepped hole of the stepped resonance tube, wherein an interference fit with stepped holes plays a role of sealing, and wherein the depth of a second order hole of the stepped resonance tube is adjusted by adjusting the axial position of the regulative plunger.

2. The step cavity type low-frequency ultrasonic atomization nozzle with a swirlable vortex impeller according to claim 1, wherein a ratio of a first stepped hole and the second stepped hole of the second-order hole of the stepped resonance tube is 1.5-3, and a ratio of a depth of the second stepped hole to the first stepped-hole is adjustable from 1-5.

3. The stepped cavity type low-frequency ultrasonic atomization nozzle with a swirlable vortex impeller according to claim 1, wherein an inner surface of the resonant cavity of the stepped resonance tube is saw-toothed, and an inclined angle of a sawtooth longitudinal section is 12-25°, and the saw tooth length is 1.5-2.5 mm.

4. The step cavity type low-frequency ultrasonic atomization nozzle with a swirlable vortex impeller according to claim 1, further comprising a pin-shaped exciter connected to the plunger body, wherein the exciter passes through the resonant cavity of the stepped resonance tube and extends to an outlet section of the Laval core.

5. The step cavity type low-frequency ultrasonic atomization nozzle with a swirlable vortex impeller according to claim 1, wherein the annular groove section on the end surface of the fixed cap has a parabolic shape defined by the formula: $X=my^2+ny+p$, wherein a slope of the endpoint curve of the center is the same as a slope of the conical surface of the taper rectifying sleeve.

6. The step cavity type low-frequency ultrasonic atomization nozzle with a swirlable vortex impeller according to claim 1, wherein the swirlable vortex impeller and the taper rectifying sleeve are internally tapered; wherein a gap between the swirlable vortex impeller and taper rectifying sleeve is 0.5-1 mm, and the gap between the wall of the center hole of the swirlable vortex impeller and the outer surface of the stepped resonance tube is 0.2-0.4 mm.

7. The step cavity type low-frequency ultrasonic atomization nozzle with a swirlable vortex impeller according to claim 1, wherein an angle $\alpha$ between a connecting line of one starting point and one ending point of a pressure surface of one blade of the swirlable vortex impeller is 25°-35°.

8. The step cavity type low frequency ultrasonic atomization nozzle with a swirlable vortex impeller according to claim 1, wherein blades of the swirlable vortex impeller are unequal thickness defined by the formula $y=ax^3+bx^2+cx+d$, a surface of the blade is defined by a cubic polynomial curve, a pressure surface profile curve is determined by the position and slope of a starting point and an ending point, the contour curve of a blade suction surface is a circular arc defined by the formula: $x^2+y^2+ex+fy+g=0$, and the suction surface profile is determined by the starting and ending points and a starting point slope.

9. The step cavity type low frequency ultrasonic atomization nozzle with a swirlable vortex impeller according to claim 1, wherein an exciter has a diameter of 0.5-0.8 mm, and the material of the plunger body is an aluminum alloy, and the outer surface of the plunger body is covered with polyurethane rubber having a thickness of 0.3-0.5 mm.

10. The step cavity type low frequency ultrasonic atomization nozzle with a swirlable vortex impeller according to claim 1, wherein:

the cone angle of the cone-shaped hole of the taper rectifying sleeve is 60°, the cone angle of the outer conical surface of the swirlable vortex impeller is 60°, the slope of the end curve of the parabola closer to the center of the fixed cap is $\sqrt{3}/3$, the outer surface of the cone of the taper rectifying sleeve is spaced from the end surface, a ring groove has an opening of 5-10 mm, and a sealing gasket is installed between the bottom end surface of the taper rectifying sleeve and the adjustable pedestal.

11. The step cavity type low frequency ultrasonic atomization nozzle with a swirlable vortex impeller according to claim 3, wherein:

the cone angle of the cone-shaped hole of the taper rectifying sleeve is 60°, the cone angle of the outer conical surface of the swirlable vortex impeller is 60°, the slope of the end curve of the parabola closer to the center of the fixed cap is $\sqrt{3}/3$, the outer surface of the cone of the taper rectifying sleeve is spaced from the end surface, a ring groove has an opening of 5-10 mm, and a sealing gasket is installed between the bottom end surface of the taper rectifying sleeve and the adjustable pedestal.

12. The step cavity type low frequency ultrasonic atomization nozzle with a swirlable vortex impeller according to claim 4, wherein:

the cone angle of the cone-shaped hole of the taper rectifying sleeve is 60°, the cone angle of the outer conical surface of the swirlable vortex impeller is 60°, the slope of the end curve of the parabola closer to the center of the fixed cap is $\sqrt{3}/3$, the outer surface of the cone of the taper rectifying sleeve is spaced from the end surface, a ring groove has an opening of 5-10 mm, and a sealing gasket is installed between the bottom end surface of the taper rectifying sleeve and the adjustable pedestal.

* * * * *